US010060013B2

(12) United States Patent
Fujimatsu et al.

(10) Patent No.: US 10,060,013 B2
(45) Date of Patent: Aug. 28, 2018

(54) STEEL HAVING SUPERIOR ROLLING FATIGUE LIFE

(71) Applicant: Sanyo Special Steel Co., Ltd., Himeji-shi (JP)

(72) Inventors: Takeshi Fujimatsu, Himeji (JP); Norimasa Tsunekage, Himeji (JP); Ichiro Takasu, Himeji (JP)

(73) Assignee: Sanyo Special Steel Co., Ltd., Himeji-shi (JP)

( * ) Notice: Subject to any disclaimer, the term of this patent is extended or adjusted under 35 U.S.C. 154(b) by 209 days.

(21) Appl. No.: 14/909,795

(22) PCT Filed: Aug. 7, 2014

(86) PCT No.: PCT/JP2014/070936

§ 371 (c)(1),
(2) Date: Feb. 3, 2016

(87) PCT Pub. No.: WO2015/020169

PCT Pub. Date: Feb. 12, 2015

(65) Prior Publication Data

US 2016/0201174 A1 Jul. 14, 2016

(30) Foreign Application Priority Data

Aug. 8, 2013 (JP) ..... 2013-165629

(51) Int. Cl.

| | |
|---|---|
| ***C22C 38/06*** | (2006.01) |
| ***C22C 38/18*** | (2006.01) |
| ***C22C 38/22*** | (2006.01) |
| ***C22C 38/44*** | (2006.01) |
| ***C22C 38/40*** | (2006.01) |
| ***C21D 9/36*** | (2006.01) |
| ***C22C 38/00*** | (2006.01) |
| ***C22C 38/02*** | (2006.01) |
| ***C22C 38/04*** | (2006.01) |
| *C21D 9/32* | (2006.01) |
| *C21D 9/40* | (2006.01) |
| *C21D 1/25* | (2006.01) |

(52) U.S. Cl.

CPC ..... *C22C 38/00* (2013.01); *C22C 38/002* (2013.01); *C22C 38/02* (2013.01); *C22C 38/04* (2013.01); *C22C 38/06* (2013.01); *C22C 38/22* (2013.01); *C22C 38/44* (2013.01); *C21D 1/25* (2013.01); *C21D 9/32* (2013.01); *C21D 9/40* (2013.01); *C21D 2211/004* (2013.01)

(58) Field of Classification Search

None

See application file for complete search history.

(56) References Cited

U.S. PATENT DOCUMENTS

| | | | |
|---|---|---|---|
| 5,705,124 | A | 1/1998 | Ochi et al. |
| 7,971,484 | B2 | 7/2011 | Sato et al. |
| 2008/0308195 | A1 | 12/2008 | Yoshihara et al. |
| 2014/0017112 | A1 | 1/2014 | Kaizuka et al. |

FOREIGN PATENT DOCUMENTS

| | | | |
|---|---|---|---|
| CN | 102105604 | A | 6/2011 |
| JP | 6192790 | A | 7/1994 |
| JP | 83682 | A | 1/1996 |
| JP | 2004323938 | A | 11/2004 |
| JP | 2006200027 | A | 8/2006 |
| JP | 2006317192 | A | 11/2006 |
| JP | 2007224413 | A | 9/2007 |
| JP | 2008121035 | A | 5/2008 |
| JP | 2012214829 | A | 11/2012 |
| JP | 5224424 | B1 | 3/2013 |
| JP | 2013185250 | A | 9/2013 |
| JP | 2013253314 | A | 12/2013 |

*Primary Examiner* — Deborah Yee

(74) *Attorney, Agent, or Firm* — The Webb Law Firm

(57) ABSTRACT

There is provided a steel, having an excellent rolling fatigue life, wherein an oxygen content in the steel is 8 ppm or less, a sulfur content is 0.008 mass % or less, and an Al content is 0.005 to 0.030 mass %, the number of non-metallic inclusions having an inclusion diameter of 20 μm or more and less than 100 μm, detected per steel material volume of 1000 $mm^3$ by ultrasonic flaw detection, is 12.0 or less, the number of non-metallic inclusions having an inclusion diameter of 100 μm or more, detected per steel material weight of 2.5 kg by the ultrasonic flaw detection, is 2.0 or less, the mass % ratio of $(MgO)/(Al_2O_3)$ in the average composition of $MgO—Al_2O_3$-based oxides present in the steel is regulated into a range of 0.25 to 1.50, and the number ratio of the $MgO—Al_2O_3$-based oxides to all oxide-based inclusions is 70% or more.

9 Claims, No Drawings

STEEL HAVING SUPERIOR ROLLING FATIGUE LIFE

CROSS-REFERENCE TO RELATED APPLICATIONS

This application is the United States national phase of International Application No. PCT/JP2014/070936 filed Aug. 7, 2014, and claims priority to Japanese Patent Application No. 2013-165629 filed on Aug. 8, 2013, the disclosures of which are hereby incorporated in their entirety by reference.

TECHNICAL FIELD

The present invention relates to a steel applied to a mechanical part or an apparatus, for which an excellent rolling fatigue life is required and which is hardened to have a surface hardness of 58 HRC or more and is used, such as a bearing, a gear, a hub unit, a toroidal CVT apparatus, a constant velocity joint, or a crank pin.

BACKGROUND ART

In recent years, with increasingly high performance in various mechanical apparatuses, usage environments of mechanical parts or apparatuses for which a rolling fatigue life is required have become severe. Thus, a demand for improvements in the operating life and reliability of these mechanical parts or apparatuses is increased. In response to such a demand, as a measure in terms of steel materials, there has been conducted proper adjustment of steel ingredients or reduction of impurity elements detrimental to a rolling fatigue life, to improve the operating life and the reliability.

Among impurity elements contained in a steel composition, for example, oxygen is an element composing an oxide-based inclusion, such as alumina, which may originate a failure. Accordingly, the content of oxygen with a particularly high detrimentalness has been reduced to ppm order. The content of oxygen may be further reduced by special melting such as VAR or ESR when further high quality is demanded. Further, measures have been taken to prevent the adverse effects of other impurity elements by reducing the contents of the elements to 0.01 mass % order.

There has been variously proposed high cleanliness steel with a low oxygen content in the steel. Among these proposals, a high-carbon-based long-life bearing steel having a value of {(the number of $MgO.Al_2O_3$+the number of MgO)/the number of all oxide-based inclusions} of 0.80 or more has been proposed in terms of the number of oxides in the steel (for example, see Patent Literature 1). In Patent Literature 1, the composition range of MgO and $Al_2O_3$ is not particularly described. Because of the expression not by $MgO—Al_2O_3$ but by $MgO.Al_2O_3$ showing a stoichiometric composition in a molecular formula, a compound comprising, in mass %, 28.3% of MgO and 71.7% of $Al_2O_3$ is expressed. Furthermore, there have been proposed a high-carbon chromium bearing steel in which the total number of alumina-based oxides and spinel-based oxides is less than 60% of the total number of oxides, and a method for producing the steel (for example, see Patent Literature 2). As far as this Patent Literature 2 is concerned, it is defined that the alumina-based oxide is an oxide in which each of (MgO) and ($SiO_2$) is less than 3% and the ratio of (CaO)/((CaO)+($Al_2O_3$)) is 0.08 or less in terms of (CaO), and the spinel-based oxide is an oxide having a spinel type crystal structure in which 15% or less (CaO) and/or 15% or less ($SiO_2$) may be mixed into a binary oxide including (MgO) in a range of 3% to 20% with the balance of ($Al_2O_3$). Furthermore, there has been proposed a high cleanliness bearing steel in which an oxygen content in the steel is less than 10 ppm and the surface-exposed area of oxide-based inclusions floated and aggregated by an electron beam melting method is 20 $\mu m^2$ or less per gram (for example, see Patent Literature 3). On the other hand, in the case of stably providing a steel having an excellent rolling fatigue life, targeted by the present invention, i.e., a steel having an excellent $L_1$ life (cycle number at which 99% of test pieces rotate without peeling when the test pieces of which the lots are the same are tested on the same condition) in a thrust type rolling fatigue test, non-metallic inclusions of more than 20 μm, influencing an $L_1$ life, are extremely accidentally and less probably generated. Therefore, it is very difficult to detect the generation of the non-metallic inclusions. Moreover, in the steel described in Patent Literature 3, inclusions are melted and aggregated, and therefore, it is likely impossible to accurately evaluate the diameters and number of inclusions. Further, in a method for evaluating non-metallic inclusions according to conventional art, examination of the large volume of a steel material requires a great deal of time due to a small area to be detected. Therefore, it is difficult to judge whether the steel material is good or poor.

Further, there has been proposed an evaluation method using, in combination, both techniques of statistics of extreme values and ultrasonic flaw detection, in which, e.g., the statistics of extreme values is applied to inclusions having a maximum inclusion diameter of approximately 100 μm or less and the ultrasonic flaw detection at a flaw detection frequency of 5 to 25 MHz is applied to inclusions of approximately 100 μm or more (for example, see Patent Literature 4). This literature proposes the evaluation method by the combination in which, e.g., the statistics of extreme values is applied to non-metallic inclusions having a maximum inclusion diameter of less than 100 μm and the ultrasonic flaw detection at a flaw detection frequency of 5 to 25 MHz is applied to non-metallic inclusions of 100 μm or more. However, in the statistics of extreme values, an area to be detected is small similarly as described above, it is possible to insufficiently judge whether a steel material is good or poor in terms of non-metallic inclusions of 20 μm or more and less than 100 μm. On the other hand, because the diameters of inclusions detected by the ultrasonic flaw detection at a flaw detection frequency of 5 to 25 MHz are 100 μm or more, it is still possible to insufficiently evaluate inclusions of 20 μm or more and less than 100 μm. Therefore, an evaluation method that enables steel having an excellent $L_1$ life to be stably provided is demanded. Further, there has been proposed steel in which the number and sizes of inclusions are set for the steel having an excellent rolling fatigue life by evaluating inclusions of 100 μm or less by ultrasonic flaw detection at a flaw detection frequency of 20 to 125 MHz (for example, see Patent Literature 5). In a method described in this Patent Literature 5, there have been proposed the steel having an excellent rolling fatigue life wherein the number of non-metallic inclusions which have a sulfur content of 0.008 mass % or less and in which the diameters of inclusions detected by ultrasonic flaw detection are 20 μm or more per steel material volume of 300 $mm^3$ is set to be 12 or less per 300 $mm^3$ (steel in which $L_{10}$ life>$1.0\times10^7$ cycles is obtained at a maximum Hertzian stress $P_{max}$=5.3 GPa in a thrust type rolling fatigue test). Also, there have been proposed an evaluation method of the steel. However, in the method, reliability against the failure of a bearing being used, occurring much earlier than a calculated life, is not evaluated, and therefore, it is possible to fail in stably providing steel having an excellent $L_1$ life (cycle number at which 99% of test pieces rotate without peeling when the test pieces of which the lots are the same are tested on the same condition) which is an index for the reliability against early failure.

CITATION LIST

Patent Literature

[Patent Literature 1] JP8-3682A
[Patent Literature 2] JP2006-200027A
[Patent Literature 3] JP6-192790
[Patent Literature 4] JP2006-317192
[Patent Literature 5] JP2008-121035

SUMMARY OF INVENTION

It is an object of the present invention to suppress failure occurring much earlier than a calculated life in a mechanical part requiring a rolling fatigue life. Thus, the present inventors paid their attention to an $L_1$ life (i.e., cycle number at which 99% of test pieces rotate without peeling when the test pieces of which the lots are the same are tested on the same condition) as an index for reliability. The $L_1$ life has not quite been evaluated in conventional art.

Thus, the present inventors intensively examined control of non-metallic inclusions, for improving a rolling fatigue life, and especially means for reducing the influence of oxide-based non-metallic inclusions having a high detrimentalness to a rolling fatigue life. As a result, it was found that as for rigid oxide-based inclusions in steel, which have been considered to need to be rather avoided in conventional art, an $L_1$ life is improved by appropriately reforming the composition ratio and number ratio of the rigid oxide-based inclusions containing $Al_2O_3$ or MgO and further regulating the number of the non-metallic inclusions in the steel per fixed amount by ultrasonic flaw detection.

That is, there were obtained findings that in order to make steel having an excellent $L_1$ life, in which peeling occurring much earlier than a calculated life can be particularly suppressed, in a part requiring a rolling fatigue life, it is preferable that an oxygen content in the steel is 8 ppm or less in mass percentage, a sulfur content is 0.008 mass % or less, an Al content is 0.005 to 0.030 mass %, in terms of non-metallic inclusions, the number of the non-metallic inclusions, in which the diameters of the inclusions detected per steel material volume of 1000 $mm^3$ by ultrasonic flaw detection (hereinafter referred to as "inclusion diameters") are 20 μm or more and less than 100 μm, is 12.0 or less, in addition, the number of the non-metallic inclusions, in which inclusion diameters detected per steel material weight of 2.5 kg by ultrasonic flaw detection are 100 μm or more, is 2.0 or less, and a mass % ratio of $(MgO)/(Al_2O_3)$ in the average composition of MgO—$Al_2O_3$-based oxides present in the steel is regulated into a range of 0.25 to 1.50, more preferably 0.30 to 1.30, and the number ratio of the MgO—$Al_2O_3$-based oxides to all oxide-based inclusions is regulated to 70% or more, preferably 80% or more. MgO—$Al_2O_3$-based non-metallic inclusions defined herein may encompass ones containing CaO of 15% or less in mass % and/or $SiO_2$ of 15% or less in mass %. The reason that the oxygen content is 8 ppm or less in mass percentage and the sulfur content is 0.008 mass % or less is because the sizes and presence frequencies of oxide-based inclusions and sulfide-based inclusions which are comparatively soft and easily drawn are reduced. More preferably, the oxygen content is 6 ppm or less in mass percentage, and the sulfur content is 0.003 mass % or less. Furthermore, it is necessary for preventing reform into soft inclusions and for suppressing generation of pure alumina ($Al_2O_3$) which easily aggregates in steel to become in cluster form although being rigid that an Al content is 0.005 to 0.030 mass %, more preferably 0.008 to 0.030 mass %, still more preferably 0.011 to 0.030 mass %.

In the steel in which the average composition of the oxide-based inclusions is regulated and the number ratio of the oxide-based inclusions to all the oxide-based inclusions is regulated to 70% or more, preferably 80% or more, as described above, the oxides had the composition having a high-melting point, and therefore, small-diameter oxides having an approximately spherical shape are crystallized from molten steel in the process of producing a steel ingot. Even in the case of the crystallization in the approximately spherical shape as described above, the oxide-based inclusions are dispersed in a small-diameter and approximately spherical shape in the ingot after the molten steel is solidified because pure alumina ($Al_2O_3$) which is then aggregated in the molten steel and easily becomes in cluster form is suppressed.

Furthermore, in a case in which the ingot is rolled to make a steel bar by hot working and the steel bar is then made as a material into a steel bar or a steel pipe to be a part material or a forged product by further hot working and cold working, the oxide-based inclusions are inclusions which are much more rigid than a matrix steel in a hot or cold working temperature range, and thus hardly follow the matrix and are hardly deformed during working, and therefore, a comparatively approximately spherical shape can be maintained even after the working.

Then, the steel bar or the steel pipe to be a part material is, if necessary, subjected to further cold working such as CRF, then cutting-worked, adjusted to not less than a surface hardness of 58 HRC desired by a part undergoing rolling fatigue by further appropriate heat treatment, and then used as a mechanical part. However, it is possible for the maximum stress application direction of the part undergoing rolling fatigue under a transfer plane not to necessarily correspond to the direction of the minimum cross section of the non-metallic inclusions in the steel material which becomes the material of the part, for example, the direction vertical to a rolling direction in the case of oxide-based inclusions or sulfide-based inclusions which are relatively soft and drawn by hot working.

Thus, when a steel containing oxide-based inclusions which were comparatively soft at high temperature and drawn by hot working was experimentally ingotted, a thrust type rolling fatigue life test was conducted by allowing a plane corresponding to a rolling direction which is the maximum cross sectional direction of the oxide-based inclusions to be a transfer plane using, as a material, a steel material obtained by hot-rolling the steel, and an $L_1$ life regarded as an index for reliability against peeling in an extremely short life was evaluated, the present inventors found that the $L_1$ life is decreased in comparison with the case of allowing the direction vertical to the rolling direction to be the transfer plane. This is presumed to be because inclusions having an oxide composition, which are soft at high temperature, have a low melting point, remaining of upsized inclusions in steel therefore occurs although occurring at a low frequency, and the direction of the maximum cross section (i.e., which can be regarded as a defect size) of the inclusions after hot rolling approximately corresponds to a maximum stress application direction. This is clarified by the evaluation of an $L_1$ life although hardly seen in an $L_{10}$ life (cycle number at which 90% of test pieces rotate without peeling when the test pieces of which the lots are the same are tested on the same condition) evaluated as an index for an ordinary part life. As for a sulfide, similarly with oxide-based inclusions with a composition which easily becomes soft in a hot environment, a difference between the maximum cross-sectional sizes of inclusions in a rolling direction and the direction vertical thereto is caused due to drawing of the inclusions by working, and therefore, a poor $L_1$ life may be caused depending on how to form the transfer plane of a part, as described above.

In contrast, it was found that unlike the results, in a steel, proposed by the present inventors, in which both of the content of oxygen forming an oxide and the content of sulfur forming a sulfide in the steel are reduced and oxide-based inclusions in the steel are dispersed in small-diameter and approximately spherical shapes, an $L_1$ life is improved in a thrust type rolling fatigue life test in which a plane corresponding to a rolling direction is allowed to be a transfer plane, and the present invention was accomplished. That is, an inclusion cross-sectional area can be always minimized with respect to a maximum stress application direction in rolling fatigue, even if a transfer plane in the case of working to a part is placed in any direction with respect to the direction of rolling or drawing an original material, by sufficiently reducing the sizes and presence frequencies of oxides and sulfides in the steel to be a material for a part and by dispersing oxide-based inclusions in the steel, especially having a high detrimentalness to a rolling fatigue life, in small-diameter and approximately spherical shapes, and therefore, the detrimentalness of the oxide-based inclusions for rolling fatigue is decreased to improve a rolling fatigue life. In addition, in the present invention, there is stably obtained a steel having an excellent $L_1$ life as an index for peeling in an extremely short life by appropriately regulating the number of non-metallic inclusions contained in the steel per fixed amount by ultrasonic flaw detection.

For the problems to be solved by the present invention, in each of the steels described in Patent Literatures 1 to 5, an $L_1$ life is not evaluated, and it is probable that reliability against peeling which occurs much earlier than the calculated life of a part is not ensured. In the steel described in Patent Literature 1, a value of {(the number of $MgO.Al_2O_3$+MgO)/the number of all oxide-based inclusions} is regulated to 0.80 or more in terms of the number of oxides in the steel, but reforming of an oxide composition to a main oxide having the stoichiometric composition of $MgO.Al_2O_3$ or MgO is a necessary condition, the addition of Mg in a refining process and the content of Mg in a steel material are essential therefor, and therefore, a production cost is increased to deteriorate general-purpose properties. Further, an oxygen content and a sulfur content are considered to be insufficiently regulated, the content frequency of non-metallic inclusions in the steel is not evaluated, and therefore, it is possible to fail to stably provide a steel having an excellent $L_1$ life.

An $L_{10}$ life is improved by regulating the total number of alumina-based oxides (mainly including $Al_2O_3$) and spinel-based oxides (based on $MgO—Al_2O_3$) to be less than 60% of the number of all oxides to perform controlling for softening an inclusion composition in the steel described in Cited Literature 2, whereas an $L_1$ life regarded as an index for reliability against peeling in an extremely short life is improved by regulating the total number of $MgO—Al_2O_3$-based oxides to be 70% or more of the number of all oxides in the present invention, and both are quite different in technical idea.

In each of Patent Literatures 3 to 5, no reforming of the chemical composition or number ratio of rigid oxide-based inclusions in the steel is suggested. In the steel described in Patent Literature 3, a steel sample for evaluating the surface exposed area of oxide-based inclusions is as small as around 1 to 5 g, the inclusions are melted and aggregated by an electron beam melting method, and therefore, it is considered to be insufficient for an index for evaluating the cleanliness of steel per fixed amount, required for improving reliability against peeling in an extremely short life, which is an object of the present invention.

In the steel described in Patent Literature 4, it is possible to fail to sufficiently evaluate non-metallic inclusions of 20 μm or more and less than 100 μm. Further, in the steel described in Patent Literature 5, the number of non-metallic inclusions having an inclusion diameter of 20 μm or more is set to be 12 or less per 300 $mm^3$, and this regulation is considered to be looser than that in the present invention.

The present invention was accomplished in order to solve such conventional problems, and a problem to be solved by the present invention is to provide a steel for a mechanical part, having an excellent rolling fatigue life, in which an oxygen content, a sulfur content, and an Al contents in the steel are regulated, a mass % ratio of $(MgO)/(Al_2O_3)$ in the average composition of $MgO—Al_2O_3$-based oxides, the number ratio of the $MgO—Al_2O_3$-based oxides to all oxides, the number of non-metallic inclusions of 20 μm or more and less than 100 μm per fixed amount in the steel, and the number of non-metallic inclusions of 100 μm or more per fixed amount in the steel are regulated, and an $L_1$ life which is an index for peeling occurring extremely early is improved.

An aspect of the present invention relates to a steel used in a mechanical part having a surface hardness of 58 HRC or more. In the steel, an oxygen content in the steel is, in mass percentage, 8 ppm or less, a sulfur content is 0.008 mass % or less, an Al content is 0.005 to 0.030 mass %, and the number of non-metallic inclusions detected per steel material volume of 1000 $mm^3$ by ultrasonic flaw detection, in which the diameters of the inclusions (hereinafter referred to as "inclusion diameters") are 20 μm or more and less than 100 μm, is 12.0 or less. Furthermore, according to an aspect of the present invention, there is provided the steel having an excellent rolling fatigue life, in which the number of non-metallic inclusions having an inclusion diameter of 100 μm or more, detected per steel material weight of 2.5 kg by ultrasonic flaw detection, is 2.0 or less, a mass % ratio of $(MgO)/(Al_2O_3)$ in an average composition of $MgO—Al_2O_3$-based oxides present in the steel is regulated into a range of 0.25 to 1.50, and the number ratio of the $MgO—Al_2O_3$-based oxides to all oxide-based inclusions is 70% or more.

According to another aspect of the present invention, there is provided a steel having an excellent rolling fatigue life, the steel used in a mechanical part having a surface hardness of 58 HRC or more, wherein an oxygen content in the steel is, in mass percentage, 8 ppm or less, a sulfur content is 0.008 mass % or less, and an Al content is 0.005 to 0.030 mass %;

the number of non-metallic inclusions having an inclusion diameter of 20 μm or more and less than 100 μm, detected per steel material volume of 1000 $mm^3$ by ultrasonic flaw detection, is 12.0 or less;

the number of non-metallic inclusions having an inclusion diameter of 100 μm or more, detected per steel material weight of 2.5 kg by the ultrasonic flaw detection, is 2.0 or less;

a mass % ratio of $(MgO)/(Al_2O_3)$ in an average composition of $MgO—Al_2O_3$-based oxides present in the steel is regulated into a range of 0.25 to 1.50; and a number ratio of the $MgO—Al_2O_3$-based oxides to all oxide-based inclusions is 70% or more.

A preferred aspect of the present invention relates to the steel used in a mechanical part having a surface hardness of 58 HRC or more. In the steel, an oxygen content in the steel is, in mass percentage, 6 ppm or less, a sulfur content is 0.003 mass % or less, an Al content is 0.005 to 0.030 mass %, and the number of non-metallic inclusions having an inclusion diameter is 20 μm or more and less than 100 μm, detected per steel material volume of 1000 $mm^3$ by ultrasonic flaw detection, is 9.0 or less. Furthermore, according to a preferred aspect of the present invention, there is provided the steel having an excellent rolling fatigue life, in which the number of non-metallic inclusions having an inclusion diameter of 100 μm or more, detected per steel material weight of 2.5 kg by the ultrasonic flaw detection, is 1.5 or less, a mass % ratio of $(MgO)/(Al_2O_3)$ in an average composition of $MgO—Al_2O_3$-based oxides present in the steel is regulated into a range of 0.25 to 1.50, and the number ratio of the $MgO—Al_2O_3$-based oxides to all oxide-based inclusions is 70% or more.

According to another preferred aspect of the present invention, there is provided the steel having an excellent rolling fatigue life according to any one of the above aspects, wherein the number of the non-metallic inclusions having an inclusion diameter of 20 μm or more and less than 100 μm is evaluated by detecting a flaw in a total volume of 1500 $mm^3$ or more by the ultrasonic flaw detection, and the number of the non-metallic inclusions having an inclusion diameter of 100 μm or more is evaluated by detecting a flaw in a total weight of 3.0 kg or more by the ultrasonic flaw detection.

According to still another preferred aspect of the present invention, the steel having an excellent rolling fatigue life is any one steel of a high-carbon chromium bearing steel (SUJ) specified in JIS (Japanese Industrial Standards) standard, 52100 specified in SAE (Society of Automotive Engineers) standard or ASTM (American Society for Testing and Materials, or also referred to as ASTM International) standard A295, 100 Cr6 specified in DIN (Deutsches Institut fur Normung) standard, a carbon steel for machine structural use (SC) specified in JIS standard, and an alloy steel for machine structural use. There is provided the steel having an excellent rolling fatigue life according to any one of the above aspects, in which the alloy steel for machine structural use specified in JIS standard is any one steel selected from chromium steels (SCr), chromium-molybdenum steels (SCM), and nickel-chrome-molybdenum steels (SNCM).

The present invention can also be applied to a foreign standard steel corresponding to JIS standard, such as 4320, 5120, 4140, 1053, or 1055 in SAE standard.

The steel having an excellent rolling fatigue life of the present invention is a steel, in which an oxygen content, a sulfur content, and an Al content in the steel are regulated, the mass % ratio of $(MgO)/(Al_2O_3)$ in the average composition of $MgO—Al_2O_3$-based oxides in the steel and the number ratio of the $MgO—Al_2O_3$-based oxides to all oxides are regulated, and, in addition, the number of non-metallic inclusions in the case of detecting the non-metallic inclusions in the steel in a large volume by ultrasonic flaw detection is limited, and which is excellent in rolling fatigue life and can be used in a mechanical part.

DESCRIPTION OF EMBODIMENTS

A steel having an excellent rolling fatigue life, which is an embodiment of the present invention, will be explained in detail below with reference to tables.

As used herein, "having surface hardness of 58 HRC or more" means "having surface hardness value of 58 or more on C-scale in Rockwell-hardness test". The Rockwell-hardness test is in conformity with JIS G 0202 specified in JIS (Japanese Industrial Standards) standard. Specifically, the measurement is performed on the C-scale at a reference load of 98.07 N (10 kgf) and a test load of 1471.0 N (150 kgf) using, as an indenter, a diamond having a curvature radius of 0.2 mm in its tip and a cone angle of 120°. Then, Rockwell hardness is calculated from an expression of $HR=100-h/2$ using a value of the penetration depth h (μm) of the indenter into a sample in the measurement.

A steel having an excellent rolling fatigue life according to an embodiment of the present invention is a steel used in a mechanical part having a surface hardness of 58 HRC or more, and in the steel, an oxygen content in the steel is, in mass percentage, 8 ppm or less, a sulfur content is 0.008 mass % or less, and an Al content is 0.005 to 0.030 mass %. Furthermore, the number of non-metallic inclusions having an inclusion diameter of 20 μm or more and less than 100 μm, detected per steel material volume of 1000 $mm^3$ by ultrasonic flaw detection at 25 to 125 MHz, is 12.0 or less. Furthermore, the number of non-metallic inclusions having an inclusion diameter of 100 μm or more, detected per steel material weight of 2.5 kg by ultrasonic flaw detection at 5 to 25 MHz, is 2.0 or less. Furthermore, in the steel having an excellent rolling fatigue life, the mass % ratio of $(MgO)/(Al_2O_3)$ in the average composition of $MgO—Al_2O_3$-based oxides present in the steel is regulated into a range of 0.25 to 1.50, and the number ratio of the $MgO—Al_2O_3$-based oxides to all oxide-based inclusions is 70% or more.

The steel having an excellent rolling fatigue life according to another embodiment of the present invention is a steel used in a mechanical part having a surface hardness of 58 HRC or more, and in the steel, an oxygen content in the steel is, in mass percentage, 6 ppm or less, a sulfur content is 0.003 mass % or less, and an Al content is 0.005 to 0.030 mass %. Furthermore, the number of non-metallic inclusions having an inclusion diameter of 20 μm or more and less than 100 μm, detected per steel material volume of 1000 $mm^3$ by ultrasonic flaw detection at 25 to 125 MHz, is 9.0 or less. Furthermore, the number of non-metallic inclusions having an inclusion diameter of 100 μm or more, detected per steel material weight of 2.5 kg by ultrasonic flaw detection at 5 to 25 MHz, is 1.5 or less. Furthermore, in the steel having an excellent rolling fatigue life, the mass % ratio of $(MgO)/(Al_2O_3)$ in the average composition of $MgO—Al_2O_3$-based oxides present in the steel is regulated into a range of 0.25 to 1.50, and the number ratio of the $MgO—Al_2O_3$-based oxides to all oxide-based inclusions is 70% or more.

In accordance with still another embodiment of the present invention, the number of the non-metallic inclusions having an inclusion diameter of 20 μm or more and less than 100 μm is evaluated by detecting a flaw in a total volume of 1500 $mm^3$ or more by ultrasonic flaw detection at 25 to 125 MHz.

Furthermore, in the above steel having an excellent rolling fatigue life, the number of the non-metallic inclusions having an inclusion diameter of 100 μm or more is evaluated by detecting a flaw in a total weight of 3.0 kg or more by ultrasonic flaw detection at 5 to 25 MHz.

In accordance with a still another embodiment of the present invention, the steel having an excellent rolling fatigue life desirably has a steel type used for an application requiring a rolling fatigue life, including a bearing. Specific examples thereof include any one steel material of a high-carbon chromium bearing steel (SUJ) specified in JIS standard, 52100 specified in SAE standard or ASTM standard A295, 100 Cr6 specified in DIN standard, a carbon steel for machine structural use specified in JIS standard, and an alloy steel for machine structural use. In the above steel having an excellent rolling fatigue life, the alloy steel for machine structural use specified in JIS standard is a steel material comprising any one steel selected from chromium steel (SCr), chromium-molybdenum steel (SCM), and nickel-chrome-molybdenum steel (SNCM) included in examples thereof, and the present invention can also be applied to a steel in foreign standard corresponding to JIS standard, such as 4320, 5120, 4140, 1053, or 1055 in SAE standard.

In the above ultrasonic flaw detection, various ultrasonic flaw detectors and probes, which have been already marketed, can be used. Examples of preferred probes include focal-type high-frequency probes and the like. The detectability of a flat-type probe is considered to be a ½ wavelength, while the detectability of a focal-type probe is a ¼ wavelength, and such a focal-type probe is preferred for evaluation with high accuracy. For the inclusions having an inclusion diameter of 20 μm or more and less than 100 μm in the present embodiment, the frequency of the probe is preferably around 25 to 125 MHz and particularly preferably around 30 to 100 MHz. For the inclusions having an inclusion diameter of 100 μm or more in the present embodiment, the frequency of the probe is preferably around 5 to 25 MHz.

In the ultrasonic flaw detection, it is preferable that a total volume for confirming the number of inclusions having an inclusion diameter of 20 μm or more and less than 100 μm is 1500 $mm^3$ or more and a total weight for confirming the number of inclusions having an inclusion diameter of 100 μm or more is 3.0 kg or more. The reason is that it is important for providing a steel having a stably obtained rolling fatigue life to obtain evaluation results that can be satisfied in view of evaluation accuracy. In addition, in a conventional evaluation method mainly based on microscopic observation, it is impossible to practically evaluate the evaluation volume and the evaluation weight in the ultrasonic flaw detection in the present embodiment because treatment time is enormous. When the ultrasonic flaw detection is performed, it is preferable that a dead zone region from a surface of a test piece to a depth depending on the frequency of the probe is excluded from an evaluation volume, if necessary, the end of the test piece, susceptible to structure abnormality due to heat treatment and the like and measurement noises in the ultrasonic flaw detection is excluded from the flaw detection range of an ultrasonic beam at a focal position, an evaluation volume in the ultrasonic flaw detection is set to be 1500 $mm^3$ or more (in the case of confirming the number of inclusions having an inclusion diameter of 20 μm or more and less than 100 μm) based on an underwater focal length range depending on the frequency and performance of the probe, and an evaluation weight in the ultrasonic flaw detection is set to be 3.0 kg or more (in the case of confirming the number of inclusions having an inclusion diameter of 100 μm or more).

The base molten steel of the steel of the present invention may be ingotted by either electric furnace process or blast furnace-converter process. Then subsequently, the methods of evaluating the mass % ratio of $(MgO)/(Al_2O_3)$ in the average composition of the $MgO—Al_2O_3$-based oxides in the steel and the number ratio of the $MgO—Al_2O_3$-based oxides will be explained below.

In the steel having an excellent rolling fatigue life of the present embodiment, the component analysis of an oxide composition and the count of the number of oxides are carried out by the energy dispersive X-ray analysis of oxide inclusions having an inclusion diameter of 1 μm or more in an area to be detected of at least 40 $mm^2$ or more selected from optional spots in the cross section of a steel material in order to evaluate the mass % ratio of $(MgO)/(Al_2O_3)$ in the average composition of the $MgO—Al_2O_3$-based oxides and the number ratio of the $MgO—Al_2O_3$-based oxides with high accuracy. It is preferable to calculate the average composition of the $MgO—Al_2O_3$-based oxides in the steel and the number ratio of the $MgO—Al_2O_3$-based oxides based on the results of the composition analysis and on the number of the counted oxides. For an oxide compounded with a sulfide or a nitride, an element composing the sulfide or the nitride is excluded to determine the average composition of the $MgO—Al_2O_3$-based oxides.

According to the present embodiment as explained above, there can be provided the steel used in a mechanical part having an excellent rolling fatigue life, in which the oxygen content, the sulfur content, and the Al content in the steel are regulated, the number of the non-metallic inclusions detected by detecting the non-metallic inclusions in the steel in a large volume by the ultrasonic flaw detection, and the average composition of the $MgO—Al_2O_3$-based oxides in the steel and the number ratio of the $MgO—Al_2O_3$-based oxides to all the oxides are regulated.

EXAMPLES

The steel having an excellent rolling fatigue life of the present invention will be more specifically explained below with reference to sample materials 1 to 28 which are examples and sample materials 29 to 34 which are comparative examples. However, the present invention is not limited to these examples.

The ingredient compositions of the sample materials are shown in Table 1. The compositions of the corresponding sample materials shown below are different as each shown in Table 1 even if being shown by the same standard name. In Table 1, a steel with a composition classified into JIS-SUJ2 steel, which was a high-carbon chromium bearing steel, was used for the sample materials 1 to 10 and the sample materials 29 to 32, a steel with a composition classified into 52100 specified in SAE standard was used for the sample material 11 and the sample material 12, a steel with a composition classified into 52100 specified in ASTM standard A295 was used for the sample material 13 and the sample material 14, a steel with a composition classified into 100 Cr6 specified in DIN standard was used for the sample material 15 and the sample material 16, a steel with a composition classified into JIS-SUJ3 steel was used for the sample material 17, a steel with a composition classified into JIS-SUJ5 steel was used for the sample material 18, a steel with a composition classified into JIS-SCr420 steel was used for the sample material 19 and the sample material 33, a steel with a composition classified into SAE-5120 steel was used for the sample material 20, a steel with a composition classified into JIS-SCM420 steel was used for the sample material 21 and the sample material 34, a steel with a composition classified into JIS-SNCM420 steel was used for the sample material 22, a steel with a composition classified into SAE-4320 steel was used for the sample material 23, a steel with a composition classified into JIS-SCM435 steel was used for the sample material 24, a steel with a composition classified into SAE-4140 steel was used for the sample material 25, a steel with a composition classified into JIS-S53C steel was used for the sample material 26, a steel with a composition classified into JIS-S55C steel was used for the sample material 27, and a steel with a composition classified into SAE-1053 steel was used for the sample material 28. The sample materials 1 to 34 were ingotted in an arc melting furnace, then subjected to ladle refining, and further degassed in a vacuum degasser, to produce ingots by continuous casting.

In this case, as for the sample materials 1 to 28 of Examples, the samples were collected as appropriate in the process of refining molten steel in advance, slag compositions were appropriately adjusted and examined to satisfy oxide composition ranges and number ratios of interest while confirming inclusion compositions, and base molten steels were ingotted. On the other hand, as for the sample material 29 and the sample material 30 of Comparative Examples, in the process of refining a base molten steel, the addition of Al into the molten steel was suppressed, and Si deoxidation is mainly carried out, to thereby perform reforming into soft inclusions. As for the sample materials 31 to 34 of Comparative Examples, in the process of refining a base molten steel, Al was positively added into the molten steel to perform deoxidation, whereby reforming was performed to make oxides having a small amount of MgO—$Al_2O_3$-based oxides and mainly containing $Al_2O_3$.

TABLE 1

| | Sample Material | C (mass %) | Si (mass %) | Mn (mass %) | S (mass %) | Cr (mass %) | Al (mass %) | O (ppm) | Selected Element |
|---|---|---|---|---|---|---|---|---|---|
| Example | 1 | 0.98 | 0.21 | 0.35 | 0.007 | 1.43 | 0.005 | 8 | |
| Example | 2 | 0.95 | 0.22 | 0.30 | 0.006 | 1.44 | 0.008 | 7 | |
| Example | 3 | 1.02 | 0.18 | 0.41 | 0.005 | 1.41 | 0.011 | 7 | |
| Example | 4 | 1.02 | 0.22 | 0.40 | 0.007 | 1.45 | 0.006 | 7 | |
| Example | 5 | 0.97 | 0.22 | 0.40 | 0.005 | 1.51 | 0.008 | 8 | |
| Example | 6 | 0.98 | 0.24 | 0.40 | 0.003 | 1.42 | 0.011 | 3 | |
| Example | 7 | 1.03 | 0.20 | 0.35 | 0.002 | 1.39 | 0.009 | 4 | |
| Example | 8 | 1.05 | 0.24 | 0.43 | 0.002 | 1.51 | 0.026 | 5 | |
| Example | 9 | 1.00 | 0.22 | 0.40 | 0.003 | 1.45 | 0.019 | 4 | |
| Example | 10 | 0.98 | 0.22 | 0.41 | 0.002 | 1.45 | 0.015 | 3 | |
| Example | 11 | 1.08 | 0.22 | 0.40 | 0.007 | 1.42 | 0.009 | 8 | |
| Example | 12 | 0.96 | 0.28 | 0.31 | 0.003 | 1.49 | 0.012 | 5 | |
| Example | 13 | 0.94 | 0.24 | 0.35 | 0.007 | 1.44 | 0.015 | 7 | |
| Example | 14 | 0.93 | 0.19 | 0.30 | 0.002 | 1.52 | 0.013 | 3 | |
| Example | 15 | 0.91 | 0.23 | 0.33 | 0.006 | 1.55 | 0.008 | 7 | |
| Example | 16 | 0.92 | 0.30 | 0.40 | 0.003 | 1.40 | 0.020 | 3 | |
| Example | 17 | 0.99 | 0.53 | 1.03 | 0.003 | 1.13 | 0.012 | 5 | |
| Example | 18 | 0.97 | 0.54 | 0.99 | 0.006 | 0.97 | 0.011 | 8 | Mo = 0.20% |
| Example | 19 | 0.19 | 0.15 | 0.82 | 0.006 | 1.00 | 0.018 | 7 | |
| Example | 20 | 0.22 | 0.18 | 0.83 | 0.008 | 0.92 | 0.013 | 7 | |
| Example | 21 | 0.23 | 0.33 | 0.82 | 0.003 | 1.05 | 0.013 | 6 | Mo = 0.18% |
| Example | 22 | 0.19 | 0.21 | 0.65 | 0.003 | 0.53 | 0.012 | 5 | Ni = 1.62%<br>Mo = 0.20% |
| Example | 23 | 0.21 | 0.22 | 0.56 | 0.003 | 0.52 | 0.018 | 4 | Ni = 1.63%<br>Mo = 0.21% |
| Example | 24 | 0.36 | 0.21 | 0.80 | 0.003 | 1.05 | 0.025 | 4 | Mo = 0.17% |
| Example | 25 | 0.41 | 0.19 | 0.91 | 0.005 | 1.05 | 0.012 | 7 | Mo = 0.22% |
| Example | 26 | 0.52 | 0.22 | 0.73 | 0.006 | 0.05 | 0.015 | 7 | |
| Example | 27 | 0.55 | 0.18 | 0.81 | 0.006 | 0.06 | 0.009 | 8 | |
| Example | 28 | 0.52 | 0.21 | 0.89 | 0.003 | 0.09 | 0.020 | 3 | |
| Comparative Example | 29 | 1.02 | 0.28 | 0.37 | 0.007 | 1.44 | 0.004 | 7 | |
| Comparative Example | 30 | 0.97 | 0.32 | 0.43 | 0.007 | 1.38 | 0.002 | 8 | |
| Comparative Example | 31 | 0.97 | 0.21 | 0.39 | 0.014 | 1.43 | 0.028 | 6 | |
| Comparative Example | 32 | 1.02 | 0.25 | 0.36 | 0.011 | 1.51 | 0.032 | 15 | |
| Comparative Example | 33 | 0.20 | 0.17 | 0.78 | 0.006 | 0.99 | 0.037 | 10 | |
| Comparative Example | 34 | 0.23 | 0.20 | 0.82 | 0.008 | 1.00 | 0.035 | 8 | Mo = 0.16% |

*The starred (*) figures fall outside the scope of Claims.

(Thrust Type Rolling Fatigue Test)

The steel materials of the sample materials 1 to 18 and the sample materials 29 to 32 were subjected to spheroidizing annealing at 800° C., and disk-shaped test pieces having an outer diameter of 52 mm, an inner diameter of 20 mm, and a thickness of 5.8 mm were produced from the direction parallel to the longitudinal direction of each of the steel materials. Such a test piece was maintained at 835° C. for 20 minutes, thereafter quenched by oil cooling, then subjected to tempering treatment at 170° C. for 90 minutes to obtain a desired hardness of 58 HRC or more, then subjected to surface polishing, and subjected to a thrust type rolling fatigue test. The steel materials of the sample materials 19 to 23, the sample material 33, and the sample material 34 were normalized at 925° C. and the steel materials of the sample material 24 and the sample material 25 were normalized at 870° C., and thereafter, disk-shaped test pieces having an outer diameter of 52 mm, an inner diameter of 20 mm, and a thickness of 8.3 mm were produced from the direction parallel to the longitudinal direction of each of the steel materials. Such a test piece was subjected to carburization treatment at 930° C., thereafter quenched by oil cooling, then subjected to tempering treatment at 180° C. for 90 minutes to obtain a desired hardness of 58 HRC or more, then subjected to surface polishing, and subjected to a thrust type rolling fatigue test. The steel materials of the sample materials 26 to 28 were normalized at 870° C., and disk-shaped test pieces having an outer diameter of 52 mm, an inner diameter of 20 mm, and a thickness of 8.3 mm were produced from the direction parallel to the longitudinal direction of each of the steel materials. Such a test piece was induction-hardened, then subjected to tempering treatment at 180° C. for 90 minutes to obtain a desired hardness of 58 HRC or more, then subjected to surface polishing, and subjected to a thrust type rolling fatigue test. The thrust type rolling fatigue test was conducted at a maximum Hertzian stress Pmax of 5.3 GPa. For determining an $L_1$ life, a censoring test at around $1.5\times10^7$ cycles was conducted to shorten a test evaluation time.

(Evaluation of Oxide Composition and Number Ratio)

For judging that the mass % ratio of $(MgO)/(Al_2O_3)$ in the average composition of the $MgO—Al_2O_3$-based oxides present in the steel was 0.25 to 1.50 and that the number ratio of the $MgO—Al_2O_3$-based oxides to all the oxide-based inclusions was 70% or more, the steel materials of the sample materials 1 to 18 and the sample materials 29 to 32 were subjected to spheroidizing annealing at 800° C., the steel materials of the sample materials 19 to 23, the sample material 33, and the sample material 34 were normalized at 925° C., and the steel materials of the sample materials 24 to 28 were normalized at 870° C., thereafter, for each thereof, each test piece having a test area of 100 $mm^2$ of 10 mm in a longitudinal direction and 10 mm in a radial direction and a thickness of 7 mm was cut out from the direction parallel to the longitudinal direction of the steel material, and quenched and tempered for the purpose of preventing non-metallic inclusions from falling during polishing, a test plane was then subjected to mirror polishing, and the component analysis of the oxide composition and the count of the number of oxides were carried out by energy dispersive X-ray analysis. The mass % ratio of $(MgO)/(Al_2O_3)$ in the average composition of the $MgO—Al_2O_3$-based oxides in the steel and the number ratio of the $MgO—Al_2O_3$-based oxides were calculated based on the results of the composition analysis and on the number of the counted oxides.

In each test piece of the sample materials, the surface hardness, the mass % ratio of $(MgO)/(Al_2O_3)$ in the average composition of the $MgO—Al_2O_3$-based oxides in the steel, and the number ratio of the $MgO—Al_2O_3$-based oxides are shown in Table 2.

TABLE 2

| | Sample Material | Surface Hardness (HRC) | $(MgO)/(Al_2O_3)$ (mass % ratio) | (The Number of $MgO—Al_2O_3$-Based Oxides)/(The Number of All Oxide-Based Inclusions) (%) |
|---|---|---|---|---|
| Example | 1 | 61.0 | 0.65 | 71 |
| Example | 2 | 61.2 | 1.34 | 78 |
| Example | 3 | 60.3 | 0.29 | 90 |
| Example | 4 | 62.1 | 0.67 | 73 |
| Example | 5 | 62.2 | 0.78 | 78 |
| Example | 6 | 62.0 | 0.55 | 83 |
| Example | 7 | 61.8 | 1.23 | 90 |
| Example | 8 | 62.5 | 0.91 | 72 |
| Example | 9 | 62.5 | 0.88 | 91 |
| Example | 10 | 62.3 | 0.76 | 85 |
| Example | 11 | 62.3 | 0.65 | 71 |
| Example | 12 | 62.1 | 1.20 | 85 |
| Example | 13 | 63.0 | 0.42 | 80 |
| Example | 14 | 60.9 | 0.69 | 75 |
| Example | 15 | 61.5 | 0.65 | 82 |
| Example | 16 | 62.4 | 1.12 | 89 |
| Example | 17 | 63.1 | 0.52 | 78 |
| Example | 18 | 63.2 | 0.82 | 71 |
| Example | 19 | 62.5 | 0.49 | 82 |
| Example | 20 | 62.0 | 0.43 | 82 |
| Example | 21 | 61.7 | 0.26 | 72 |
| Example | 22 | 62.7 | 0.52 | 73 |
| Example | 23 | 62.2 | 0.91 | 83 |
| Example | 24 | 61.6 | 0.72 | 75 |
| Example | 25 | 61.3 | 0.42 | 72 |
| Example | 26 | 61.2 | 0.78 | 76 |
| Example | 27 | 62.5 | 0.55 | 88 |
| Example | 28 | 63.5 | 1.18 | 73 |
| Comparative Example | 29 | 60.0 | 0.13 | 26 |
| Comparative Example | 30 | 60.3 | 0.24 | 18 |
| Comparative Example | 31 | 61.4 | 0.17 | 37 |
| Comparative Example | 32 | 62.3 | 0.10 | 36 |
| Comparative Example | 33 | 63.3 | 0.12 | 8 |
| Comparative Example | 34 | 62.7 | 0.05 | 6 |

In each of the sample materials 29 to 34 of Comparative Examples in Table 2, the mass % ratio of $(MgO)/(Al_2O_3)$ in the average composition of the $MgO—Al_2O_3$-based oxides in the steel and/or the number ratio of the number of the $MgO—Al_2O_3$-based oxides in the steel fall outside the scope of Claims in the present invention. In contrast to the sample materials 29 to 34 of the comparative Examples, the sample materials 1 to 28 of Examples in which both of the mass % ratio of $(MgO)/(Al_2O_3)$ in the average composition of the $MgO—Al_2O_3$-based oxides in the steel and the number ratio of the $MgO—Al_2O_3$-based oxides in the steel satisfy the scope of Claims in the present invention are superior in $L_1$ life to Comparative Examples, as described below.

(Ultrasonic Test)

For evaluating non-metallic inclusions having an inclusion diameter of 20 μm or more and less than 100 μm, the steel materials of the sample materials 1 to 18 and the sample materials 29 to 32 were subjected to spheroidizing annealing at 800° C., and L cross-section test pieces were cut out and subjected to quenching and tempering treatment, the steel materials of the sample materials 19 to 23, the sample material 33, and the sample material 34 were normalized at 925° C., and L cross-section test pieces were cut out and subjected to quenching and tempering treatment, and the steel materials of the sample materials 24 to 28 were normalized at 870° C., and L cross-section test pieces were cut out and subjected to quenching and tempering treatment, and thereafter, all the test pieces were subjected to plane polishing for the purpose of reducing the transfer loss of ultrasonic waves. Each of the test pieces was finished to have a thickness of 10 mm by the plane polishing, and was subjected to an ultrasonic flaw detection test. For the ultrasonic flaw detection, an ultrasonic flaw detector including a focal-type high-frequency probe (50 MHz) was used. Further, an ultrasonic flaw detection volume was 3000 $mm^3$. The number of detected inclusions of 20 μm or more and less than 100 μm per steel material volume of 1000 $mm^3$ was determined from the obtained data of reflected waves due to the inclusions.

For evaluating non-metallic inclusions having an inclusion diameter of 100 μm or more, the steel materials of the sample materials 1 to 18 and the sample materials 29 to 32 were subjected to spheroidizing annealing at 800° C., and L cross-section test pieces were cut out, the steel materials of the sample materials 19 to 23, the sample material 33, and the sample material 34 were normalized at 925° C., and L cross-section test pieces were cut out, and the steel materials of the sample materials 24 to 28 were normalized at 870° C., and L cross-section test pieces were cut out, and thereafter, each of the test pieces was finished to have a thickness of 45 mm by plane polishing, and was subjected to an ultrasonic flaw detection test. For the ultrasonic flaw detection, an ultrasonic-flaw detector including a focal-type high-frequency probe (10 MHz) was used. Further, an ultrasonic flaw detection weight was 10.0 kg. The number of detected inclusions of 100 μm or more per steel material weight of 2.5 kg was determined from the obtained data of reflected waves due to the inclusions.

In each test piece of the sample materials, the surface hardness, the number of detected inclusions per steel material volume of 1000 $mm^3$ evaluated with a focal-type high-frequency probe at 50 MHz by ultrasonic flaw detection, the number of detected inclusions per steel material weight of 2.5 kg evaluated with a focal-type high-frequency probe at 10 MHz by ultrasonic flaw detection, and the $L_1$ life in a thrust type rolling fatigue test are shown in Table 3.

TABLE 3

| | Sample Material | The Number of Inclusions Detected with 50 MHz Ultrasonic Probe (/1000 $mm^3$) | The Number of Inclusions Detected with 10 MHz Ultrasonic Probe (/2.5 kg) | $L_1$ Life |
|---|---|---|---|---|
| Example | 1 | 10.0 | 2.0 | 3.3 |
| Example | 2 | 9.3 | 1.8 | 3.8 |
| Example | 3 | 8.3 | 1.8 | 3.6 |
| Example | 4 | 9.7 | 1.8 | 3.5 |
| Example | 5 | 12.0 | 1.5 | 3.9 |
| Example | 6 | 8.3 | 0.8 | 4.5 |
| Example | 7 | 7.7 | 0.8 | 5.0 |
| Example | 8 | 1.7 | 0 | 4.9 |
| Example | 9 | 5.0 | 1.0 | 4.6 |
| Example | 10 | 3.3 | 1.3 | 5.4 |
| Example | 11 | 8.7 | 2.0 | 4.0 |
| Example | 12 | 8.0 | 1.3 | 4.3 |
| Example | 13 | 10.3 | 1.8 | 3.9 |
| Example | 14 | 5.3 | 1.5 | 4.9 |
| Example | 15 | 10.3 | 1.8 | 3.5 |
| Example | 16 | 2.0 | 1.3 | 4.5 |
| Example | 17 | 3.7 | 1.0 | 4.4 |
| Example | 18 | 9.3 | 1.5 | 3.8 |
| Example | 19 | 11.0 | 1.8 | 3.8 |
| Example | 20 | 9.0 | 2.0 | 3.7 |
| Example | 21 | 7.3 | 0.8 | 4.4 |
| Example | 22 | 6.3 | 0.8 | 4.5 |
| Example | 23 | 6.0 | 0.3 | 4.5 |
| Example | 24 | 3.3 | 0.5 | 5.0 |
| Example | 25 | 6.0 | 1.5 | 3.5 |
| Example | 26 | 9.7 | 2.0 | 3.7 |
| Example | 27 | 10.3 | 2.0 | 3.6 |
| Example | 28 | 5.0 | 0.5 | 4.8 |
| Comparative Example | 29 | 17.0 | 4.8 | 2.1 |
| Comparative Example | 30 | 16.0 | 4.3 | 1.4 |
| Comparative Example | 31 | 17.0 | 2.8 | 2.2 |
| Comparative Example | 32 | 27.7 | 5.8 | 1 |
| Comparative Example | 33 | 23.3 | 6.3 | 1.1 |
| Comparative Example | 34 | 15.0 | 3.3 | 1.6 |

*Each $L_1$ life is a relative value based on the $L_1$ life of Comparative Example 32.

In Table 3, the sample materials 1-5, sample materials 11, sample materials 13, sample materials 15, sample materials 18 to 20, and sample materials 25 to 27 of Examples satisfy the present invention and have $L_1$ lives (relative values based on Comparative Example 32) of which the minimum value is 3.3 in the sample material 1.

Each of the cases falls within the scope of the present invention, in which an oxygen content in the steel is, in mass percentage, 8 ppm or less, a sulfur content is 0.008 mass % or less, the number of non-metallic inclusions having an inclusion diameter of 20 μm or more and less than 100 μm, detected per steel material volume of 1000 $mm^3$ by ultrasonic flaw detection, is 12.0 or less, the number of non-metallic inclusions having an inclusion diameter of 100 μm or more, detected per steel material weight of 2.5 kg, is 2.0 or less, the mass % ratio of $(MgO)/(Al_2O_3)$ in the average composition of $MgO—Al_2O_3$-based oxides present in the steel is in a range of 0.25 to 1.50, and the number ratio of the $MgO—Al_2O_3$-based oxides to all oxide-based inclusions is 70% or more.

The sample materials 6 to 10, sample material 12, sample material 14, sample material 16, sample material 17, sample materials 21 to 24, and sample material 28 of Examples, in which an oxygen content in the steel is, in mass percentage, 6 ppm or less, a sulfur content is 0.003 mass % or less, the number of non-metallic inclusions having an inclusion diameter of 20 μm or more and less than 100 μm, detected per steel material volume of 1000 $mm^3$ by ultrasonic flaw detection, is 9.0 or less, the number of non-metallic inclusions having an inclusion diameter of 100 μm or more, detected per steel material weight of 2.5 kg, is 1.5 or less, the mass % ratio of $(MgO)/(Al_2O_3)$ in the average composition of $MgO—Al_2O_3$-based oxides present in the steel is in a range of 0.25 to 1.50, and the number ratio of the $MgO—Al_2O_3$-based oxides to all oxide-based inclusions is 70% or more, are in accordance with preferred aspects of the present invention, have $L_1$ lives (relative values based on Comparative Example 32) of which the minimum is 4.3 in the sample material 12, and are steels still superior in rolling fatigue life.

In contrast, the sample materials 29 to 34 of Comparative Example fall outside the scope of the present invention, in which e.g., the number of non-metallic inclusions of 20 μm or more and less than 100 μm, detected per steel material volume of 1000 $mm^3$, is more than 12.0, the number of non-metallic inclusions of 100 μm or more, detected per steel material weight of 2.5 kg, is more than 2.0, the mass % ratio of $(MgO)/(Al_2O_3)$ in the average composition of $MgO—Al_2O_3$-based oxides present in the steel deviates from the range of 0.25 to 1.50, and the number ratio of the $MgO—Al_2O_3$-based oxides to all oxide-based inclusions is less than 70%. The sample materials 29 to 34 of Comparative Examples have $L_1$ lives (relative values based on Comparative Example 32), of which the maximum value is 2.2 in the sample material 31, and are inferior to those of the present examples.

The invention claimed is:

1. A steel having an excellent rolling fatigue life, the steel used in a mechanical part having a surface hardness of 58 HRC or more, wherein an oxygen content in the steel is, in mass percentage, 8 ppm or less, a sulfur content is 0.008 mass % or less, and an Al content is 0.005 to 0.030 mass %;

a number of non-metallic inclusions having an inclusion diameter of 20 μm or more and less than 100 μm, detected per steel material volume of 1000 $mm^3$ by ultrasonic flaw detection, is 12.0 or less;

a number of non-metallic inclusions having an inclusion diameter of 100 μm or more, detected per steel material weight of 2.5 kg by ultrasonic flaw detection, is 2.0 or less;

a mass % ratio of $(MgO)/(Al_2O_3)$ in an average composition of $MgO—Al_2O_3$-based oxides present in the steel is regulated into a range of 0.25 to 1.50; and a number ratio of the $MgO—Al_2O_3$-based oxides to all oxide-based inclusions is 70% or more.

2. The steel having an excellent rolling fatigue life according to claim 1, wherein the oxygen content in the steel is, in mass percentage, 6 ppm or less, and the sulfur content is 0.003 mass % or less;

the number of the non-metallic inclusions having an inclusion diameter of 20 μm or more and less than 100 μm, detected per steel material volume of 1000 $mm^3$ by ultrasonic flaw detection, is 9.0 or less; and the number of the non-metallic inclusions having an inclusion diameter of 100 μm or more, detected per steel material weight of 2.5 kg by ultrasonic flaw detection, is 1.5 or less.

3. The steel having an excellent rolling fatigue life according to claim 1, wherein the number of the non-metallic inclusions having an inclusion diameter of 20 μm or more and less than 100 μm is evaluated by detecting a flaw in a total volume of 1500 $mm^3$ or more by the ultrasonic flaw detection; and the number of the non-metallic inclusions having an inclusion diameter of 100 μm or more is evaluated by detecting a flaw in a total weight of 3.0 kg or more by the ultrasonic flaw detection.

4. The steel having an excellent rolling fatigue life according to claim 1, wherein the steel is:

a high-carbon chromium bearing steel specified in JIS standard;

52100 specified in SAE standard or ASTM standard A295;

100 Cr6 specified in DIN standard;

a carbon steel for machine structural use specified in JIS standard; or an alloy steel for machine structural use, which is any one steel selected from chromium steels, chromium-molybdenum steels, and nickel chrome molybdenum steels.

5. The steel having an excellent rolling fatigue life according to claim 2, wherein the number of the non-metallic inclusions having an inclusion diameter of 20 μm or more and less than 100 μm is evaluated by detecting a flaw in a total volume of 1500 $mm^3$ or more by the ultrasonic flaw detection; and the number of the non-metallic inclusions having an inclusion diameter of 100 μm or more is evaluated by detecting a flaw in a total weight of 3.0 kg or more by the ultrasonic flaw detection.

6. The steel having an excellent rolling fatigue life according to claim 2, wherein the steel is:

a high-carbon chromium bearing steel specified in JIS standard;

52100 specified in SAE standard or ASTM standard A295;

100 Cr6 specified in DIN standard;

a carbon steel for machine structural use specified in JIS standard; or an alloy steel for machine structural use, which is any one steel selected from chromium steels, chromium-molybdenum steels, and nickel chrome molybdenum steels.

7. The steel having an excellent rolling fatigue life according to claim 3, wherein the steel is:

a high-carbon chromium bearing steel specified in JIS standard;

52100 specified in SAE standard or ASTM standard A295;

100 Cr6 specified in DIN standard;

a carbon steel for machine structural use specified in JIS standard; or an alloy steel for machine structural use, which is any one steel selected from chromium steels, chromium-molybdenum steels, and nickel chrome molybdenum steels.

8. The steel having an excellent rolling fatigue life according to claim 1, wherein the Al content is 0.005 to 0.009 mass %.

9. The steel having an excellent rolling fatigue life according to claim 1, wherein the mass % ratio of $(MgO)/(Al_2O_3)$ in the average composition of $MgO—Al_2O_3$-based oxides present in the steel is regulated into a range of 0.42 to 1.50.

* * * * *